United States Patent [19]

Nishikawa et al.

[11] Patent Number: 4,706,634

[45] Date of Patent: Nov. 17, 1987

[54] FUEL-INJECTION CONTROL SYSTEM

[75] Inventors: Toshihide Nishikawa; Kenichirou Hanada, both of Hiroshima Prefecture; Yukinobu Nishimura; Setsuhiro Shimomura, both of Himeji City, all of Japan

[73] Assignees: Mazda Motor Corporation; Mitsubishi Denki Kabushiki Kaisha, both of Japan

[21] Appl. No.: 930,010

[22] Filed: Nov. 13, 1986

[30] Foreign Application Priority Data

Nov. 13, 1985 [JP] Japan ..... 60-254073

[51] Int. Cl.[4] ..... F02D 41/10; F02M 51/00

[52] U.S. Cl. ..... 123/492; 364/431.07; 123/480

[58] Field of Search ..... 123/478, 480, 492, 494; 364/431.07

[56] References Cited

U.S. PATENT DOCUMENTS

| | | | |
|---|---|---|---|
| 4,463,732 | 8/1984 | Isobe et al. | 123/492 |
| 4,481,927 | 11/1984 | Miki et al. | 123/492 X |
| 4,490,792 | 12/1984 | Deutsch et al. | 123/492 X |
| 4,528,964 | 7/1985 | Kashiwaya et al. | 123/492 |
| 4,561,404 | 12/1985 | Kanno et al. | 123/492 |
| 4,573,443 | 3/1986 | Watanabe et al. | 123/492 |
| 4,612,904 | 9/1986 | Tadokoro et al. | 123/492 |

*Primary Examiner*—Willis R. Wolfe, Jr.

*Attorney, Agent, or Firm*—Leydig, Voit & Mayer

[57] ABSTRACT

A novel and improved fuel-injection control system for an internal combustion engine capable of effecting minute or fine revisions of acceleration of an engine by appropriately processing an output signal from an AFS without employing a throttle sensor for detecting the opening degree of a throttle valve. The width of a basic injection pulse is calculated from the amount of intake air sucked into an internal combustion engine and the number of engine revolutions so that between the injection pulses synchronized with the number of engine revolutions, a series of special injection pulses having the calculated pulse width are generated for revision of engine acceleration. The fuel-injection control system comprises: an arithmetic operation means for calculating an engine load from the amount of intake air sucked into the engine and the number of engine revolutions; a judging means for judging whether or not a parameter representative of the engine load is less than a predetermined reference value; a first pulse-generating means adapted to generate a first special injection pulse in response to the amount of the suction air when the judging means judges that the parameter is less than the predetermined reference value; a second pulse-generating means adapted to revise the engine acceleration outside a pulsation range in which the amount of the intake air pulsates during a first predetermined period of time starting from the generation of the first special injection pulse and to generate a series of special injection pulses; and a revision-prohibiting means for prohibiting the revision of engine acceleration in the pulsation range of the intake air during a second predetermined period of time exceeding the first predetermined period starting from the generation of the first special injection pulse.

8 Claims, 7 Drawing Figures

FOR AN INTERNAL COMBUSTION ENGINE FUEL-INJECTION CONTROL SYSTEM

BACKGROUND OF THE INVENTION

1. Field of the Invention

The present invention relates to a fuel-injection control system for an internal combustion engine adapted to revise engine acceleration on the basis of the amount of air intake.

2. Description of the Prior Art

FIG. 6 shows a general arrangement of a conventional fuel-injection control system employing an air flow-rate sensor (referred to as an AFS hereinafter) adapted to detect the amount of intake air sucked into an internal combustion engine. The fuel-injection control system illustrated includes an air cleaner 1, a hot-wire type AFS 2, a throttle valve 3 for controlling the amount of intake air sucked into an engine, a throttle sensor 4 operably connected with the throttle valve 3 for picking out the opening degree of the throttle valve 3 as a voltage signal, a surge tank 5, an intake manifold 6, an intake valve adapted to be operated by an engine crank shaft (not shown) through a valve operating mechanism (not shown), a plurality of engine cylinders 8 only one of which is actually illustrated for simplification, a fuel injector 9 provided for each engine cylinder 8, and an electronic control unit 10 (referred to as an ECU hereinafter) adapted to control the amount of fuel injected by each of the fuel injectors 9 in relation to the amount of intake air sucked in by the corresponding one of the engine cylinders 8 in such a manner as to provide a predetermined air/fuel ratio. The electronic control unit 10 functions to determine the amount of fuel injected by the respective fuel injectors 9 on the basis of control signals from the AFS 2, a crank-angle sensor for detecting the rotation angle of the engine crank shaft (not shown), a starter switch 12, a temperature sensor 13 for detecting the temperature of engine coolant, and the throttle sensor 4, and the electronic control unit 10 also controls the pulse width of an electric pulse signal for each of the fuel injectors 9 in synchronization with a signal from the crank-angle sensor 11.

FIG. 7 shows various wave forms of control signals for explaining a fuel injection process during engine acceleration in accordance with the conventional hardware arrangement as illustrated in FIG. 6. In FIG. 7, the engine is raced or accelerated rapidly from no load 750 rpm with the throttle valve 3 being operated from a fully closed to a fully opened state. FIG. 7(*a*) shows the output signal of the AFS 2, and FIG. 7(*b*) shows the output signal of the crank-angle sensor 11 in which the falling points are TDC (top dead center) and the rising points are BDC (bottom dead center) with an interval between the adjacent TDCs being equal to a crank angle of 180°. FIG. 7(*c*) shows the output signal of the throttle sensor 4 which is sampled at intervals of a $\Delta t$ time period so as to obtain a differential opening $\Delta\theta$. In this connection, when the differential opening $\Delta\theta$ is equal to or larger than a predetermined value, that is when $\Delta\theta \geqq \theta_o$, there will be issued special pulses which are separate from injection pulses and synchronized with a signal representative of both the crank angle and the number of revolutions of the crank shaft (not shown), as illustrated by pulses designated by the shaded areas in FIGS. 7(*d*) through 7(*g*). In addition, FIGS. 7(*d*) through 7(*g*) show pulse forms of injection signals in respective engine cylinders of a four-cylinder internal combustion engine in which fuel for the respective engine cylinders is injected simultaneously from the respective fuel injectors 9.

It is considered that the above-described special pulses are essential for today's finer evaluation of engine response on the points of running performance of a vehicle and pickup during acceleration of an engine. However, provision of a throttle sensor for revising engine acceleration is uneconomical and it is desirable to effect such revision of acceleration by utilizing an output signal from the AFS. In cases where the same processing as that with the throttle sensor is effected in the AFS during acceleration of an engine, the full throttle range (that is the vibration range in FIG. 7(*a*)) is entirely judged to be acceleration due to a pulsating or blowback phenomenon.

To avoid this, it has been considered to average the signals from the AFC between the adjacent TDCs, and then compare the change rates of the averaged AFC signals at respective TDCs.

In this case, however, experiments have showed that the timing at which the respective special pulses are generated must be such that the first special pulse is generated within a period of time of 20 ms after acceleration. But, in this connection, at a rotational speed of the engine of 750 rpm, the interval between the adjacent TDCs is 40 ms, and hence if the acceleration timing is 40 ms, a duration of 20 ms, required for generating the first special pulse, elapses. Accordingly, there is no choice but to employ a throttle sensor for effecting acceleration correction.

Thus, with the conventional fuel-injection control system for an internal combustion engine, an expensive throttle sensor is required for the minute or finer revisions of engine acceleration, as set forth above.

SUMMARY OF THE INVENTION

In view of the above, the present invention is intended to obviate the above-described problems of the prior art, and has for its object the provision of a novel and improved fuel-injection control system for an internal combustion engine which is capable of effecting minute or finer revision of acceleration of an engine by appropriately processing signals from an AFS without employing a throttle sensor.

In order to achieve the above object, according to the present invention, there is provided a fuel-injection control system for an internal combustion engine in which a basic injection pulse width is calculated from the amount of intake air sucked into an internal combustion engine and the number of engine revolutions so that between the injection pulses synchronized with the number of engine revolutions, a series of special injection pulses having the calculated pulse width are generated for revision of engine acceleration, the fuel-injection control system comprising:

an arithmetic operation means for calculating an engine load from the amount of intake air sucked into the engine and the number of engine revolutions;

a judging means for judging whether or not a parameter representative of the engine load is less than a predetermined reference value;

a first pulse-generating means adapted to generate a first special injection pulse in response to the amount of intake air when the judging means judges that the parameter is less than the predetermined reference value;

a second pulse-generating means adapted to revise the engine acceleration outside a pulsation range in which the amount of the intake air pulsates during a first predetermined period of time starting from the generation of the first special injection pulse and to generate a series of special injection pulses; and a revision-prohibiting means for prohibiting the revision of engine acceleration in the pulsation range of the intake air during a second predetermined period of time exceeding the first predetermined period starting from the generation of the first special injection pulse.

It is preferable that the second pulse-generating means be adapted to generate the special injection pulse each time the amount of the intake air reaches predetermined thresholds set at predetermined intervals.

The predetermined intervals between the predetermined thresholds may preferably be set in a manner such that the first one of the intervals between the predetermined thresholds is less than the other ones of the intervals.

In one embodiment, the parameter representative of the engine load is a charging efficiency of the engine.

The above and other objects, features and advantages of the present invention will become apparent from the following detailed description of a presently preferred embodiment of the invention when taken in conjunction with the accompanying drawings.

DESCRIPTION OF THE PREFERRED EMBODIMENT

Now, the present invention will be described in detail with reference to a presently preferred embodiment thereof illustrated in FIGS. 1 through 5 of the accompanying drawings.

Figure 1:
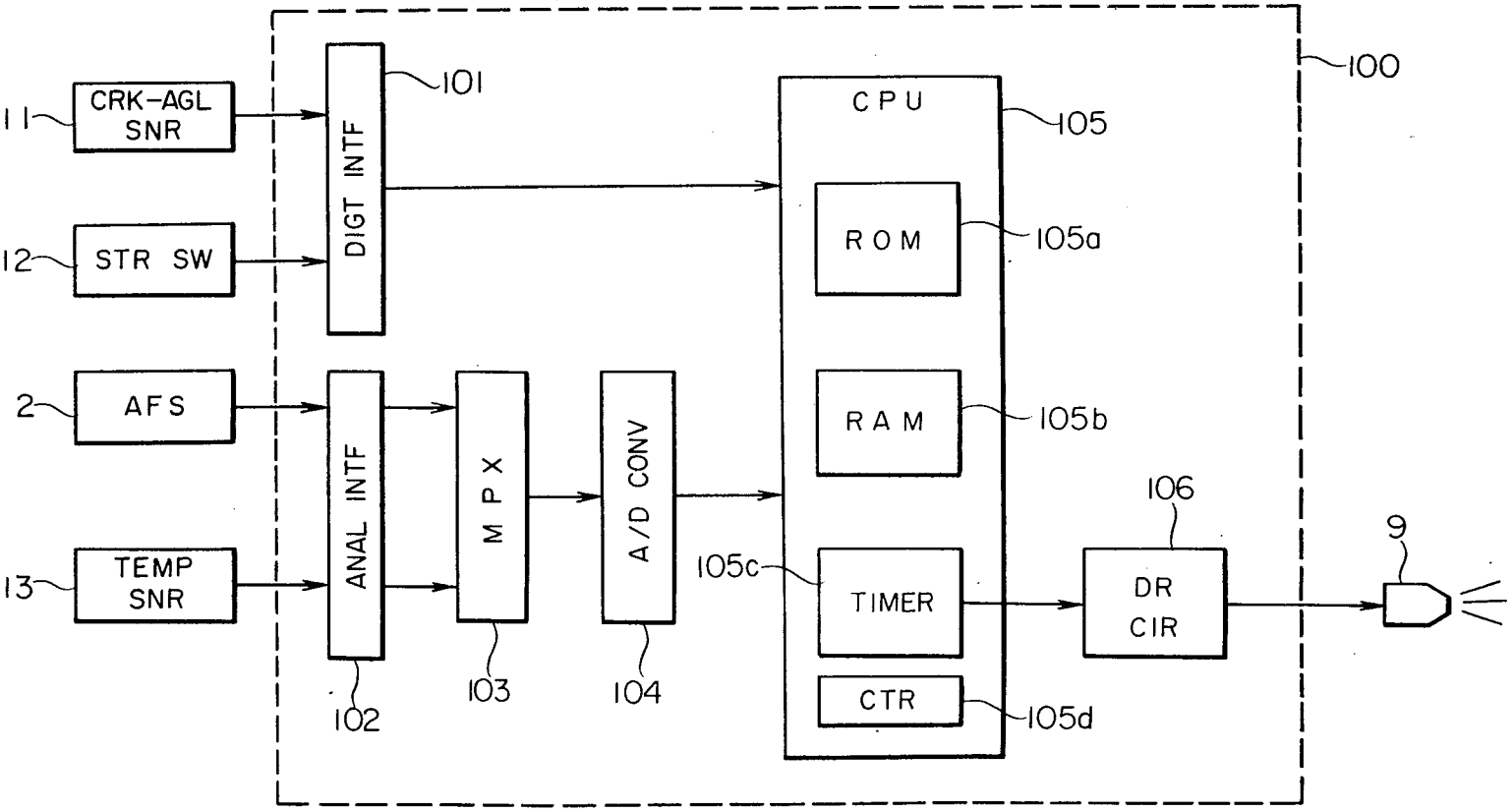
FIG. 1 is a block diagram showing hardware of an ECU in accordance with one embodiment of the present invention.
Figure 3:
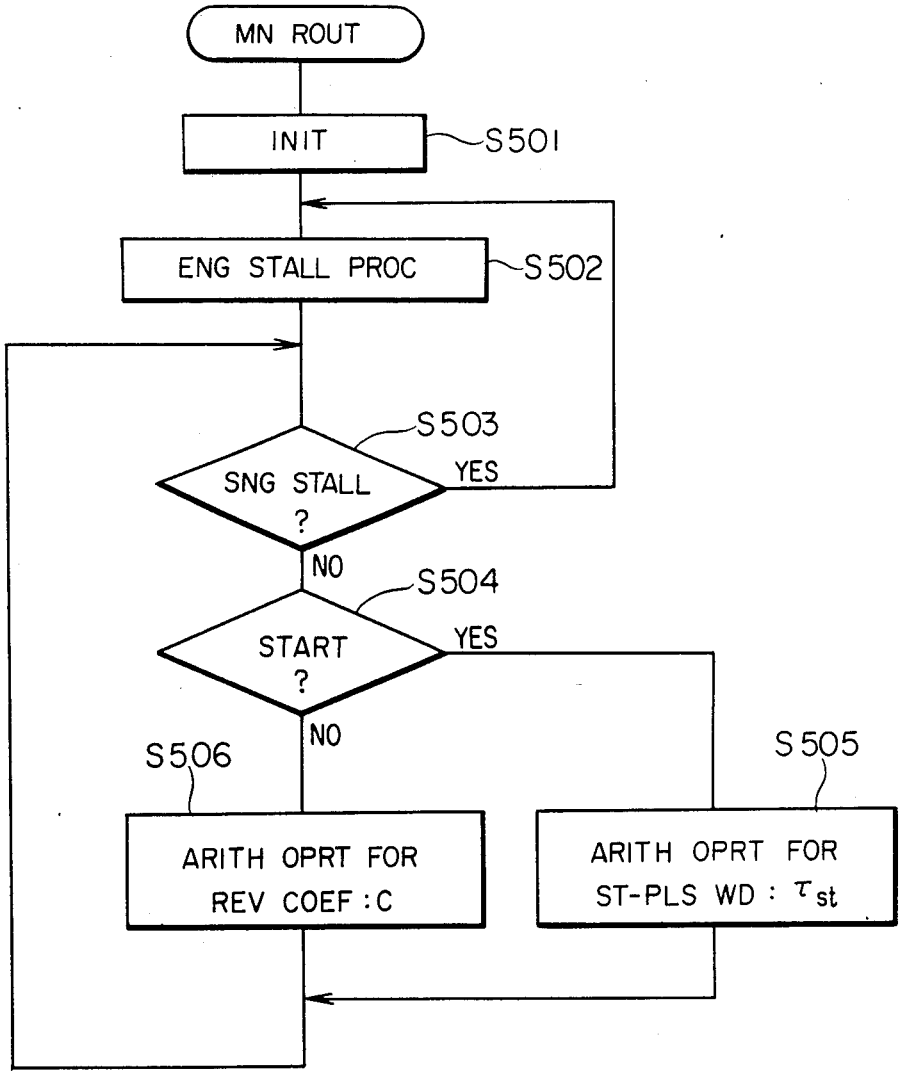
FIG. 3 is a flow chart of a control program showing a main routine for operating the ECU.
Figure 4:
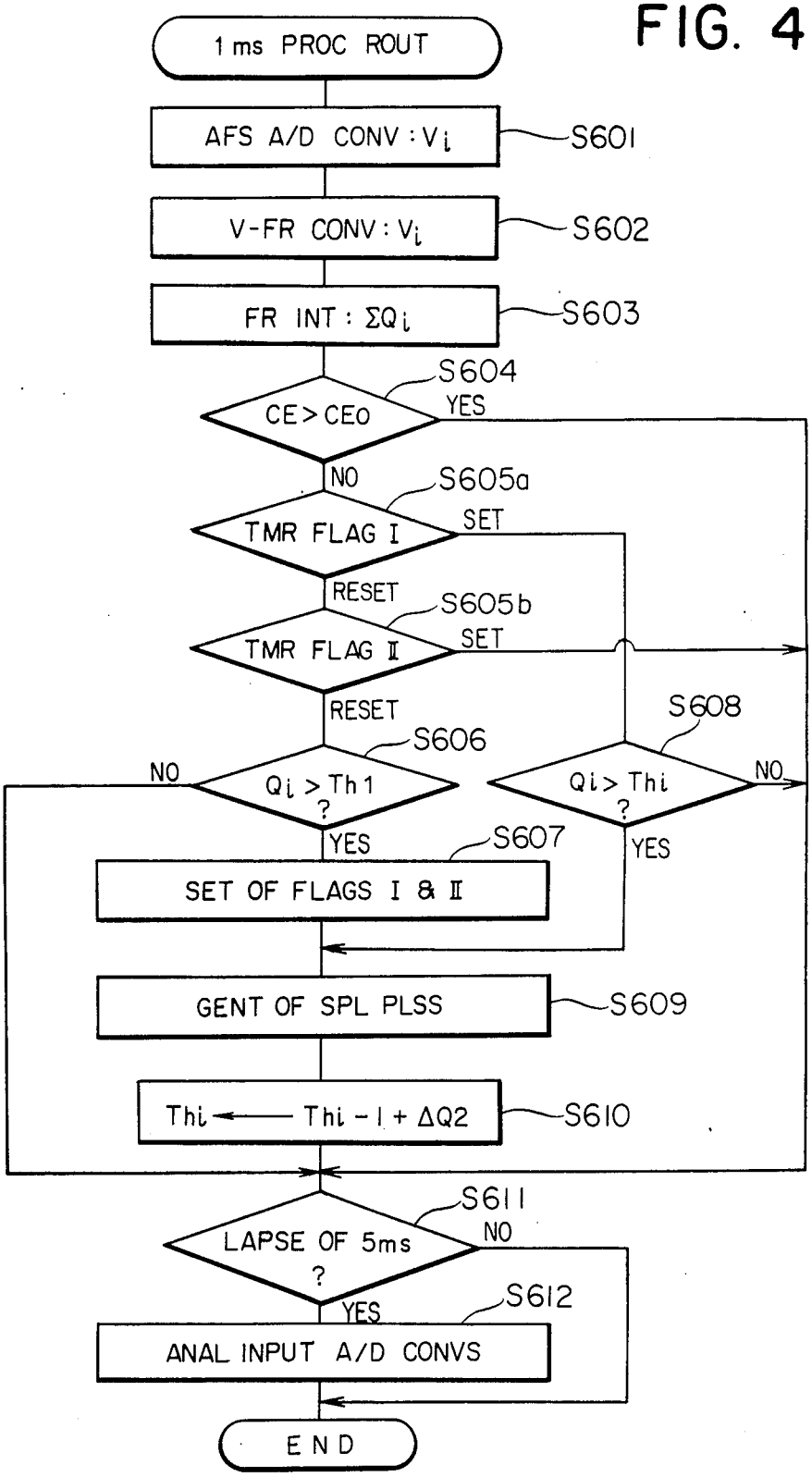
FIG. 4 is a flow chart of a control program showing a 1 ms interruption routine for operating the ECU.
Figure 5:
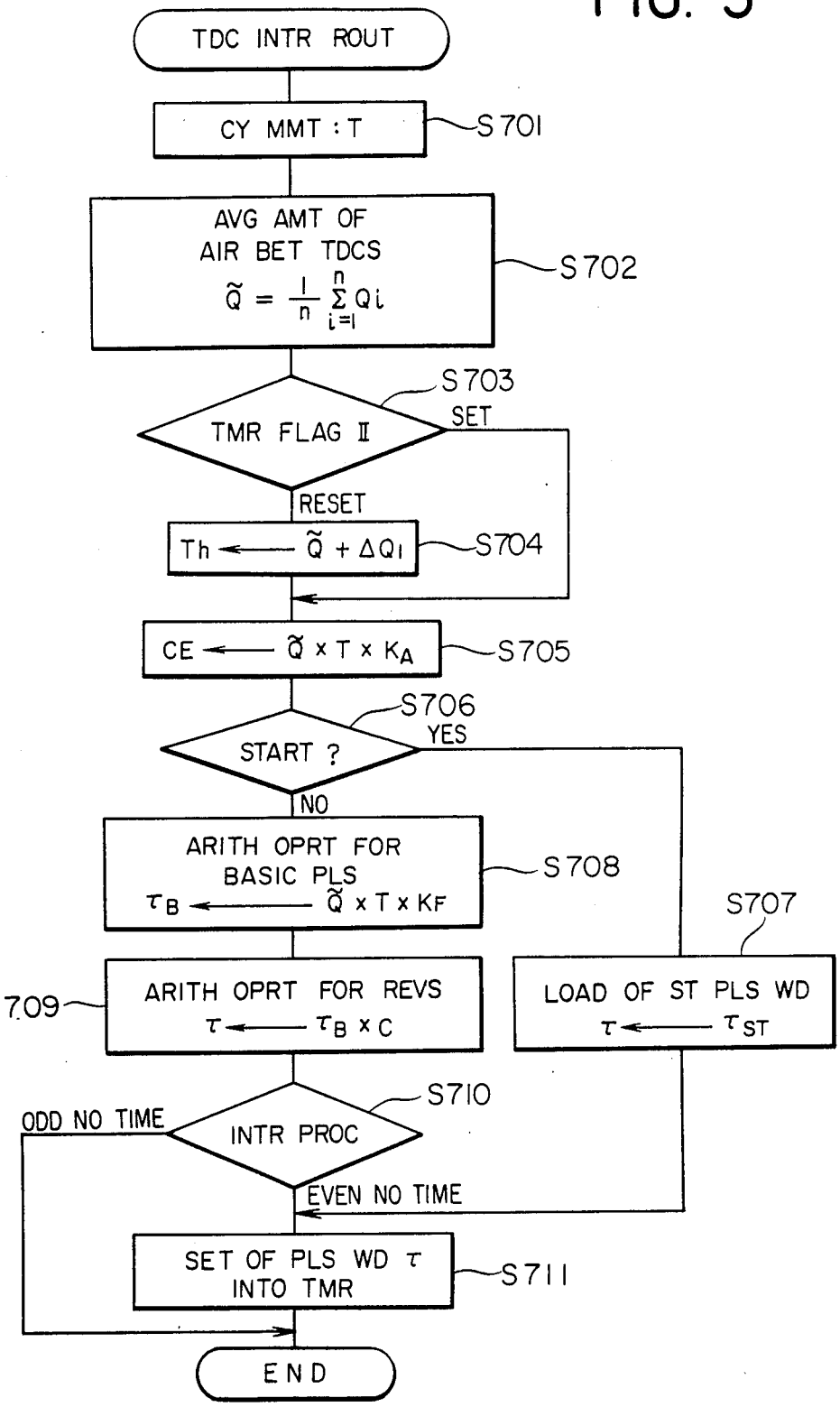
FIG. 5 is a flow chart of a control program showing a TDC interruption routine for operating the ECU.
Figure 6:
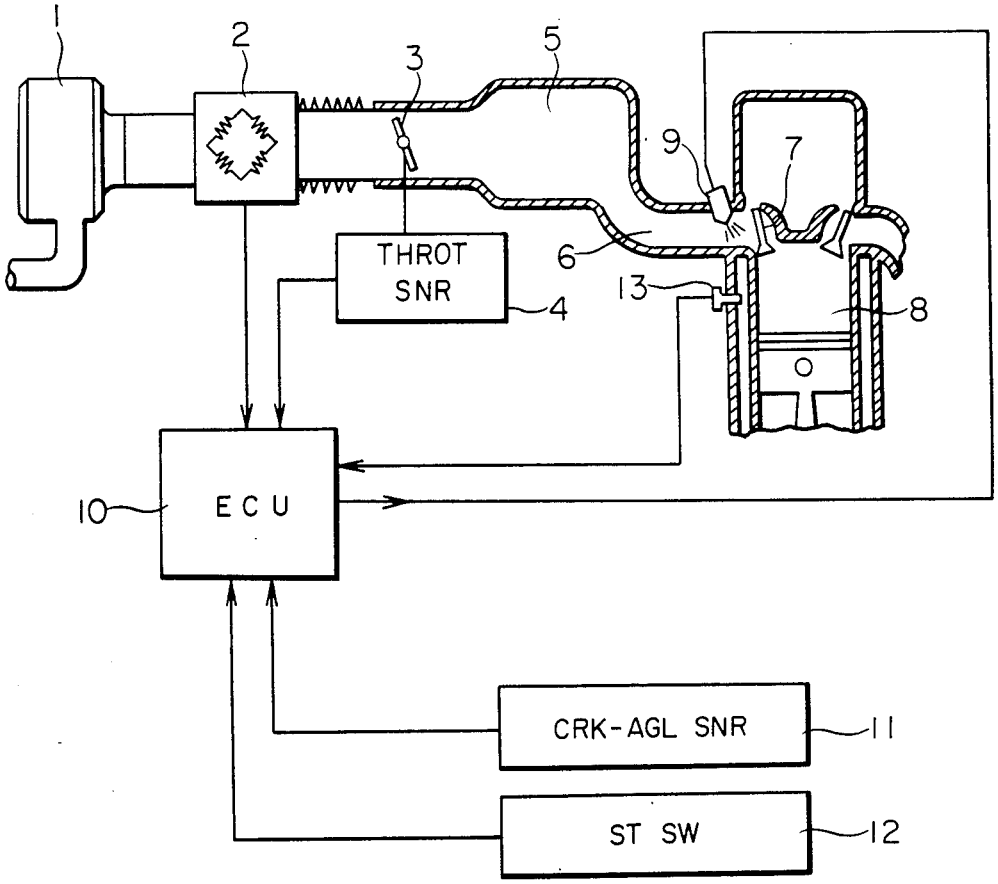
FIG. 6 is a schematic view, in partial cross section, showing a general arrangement of a conventional fuel-injection control system employing an AFS.
Figure 7:
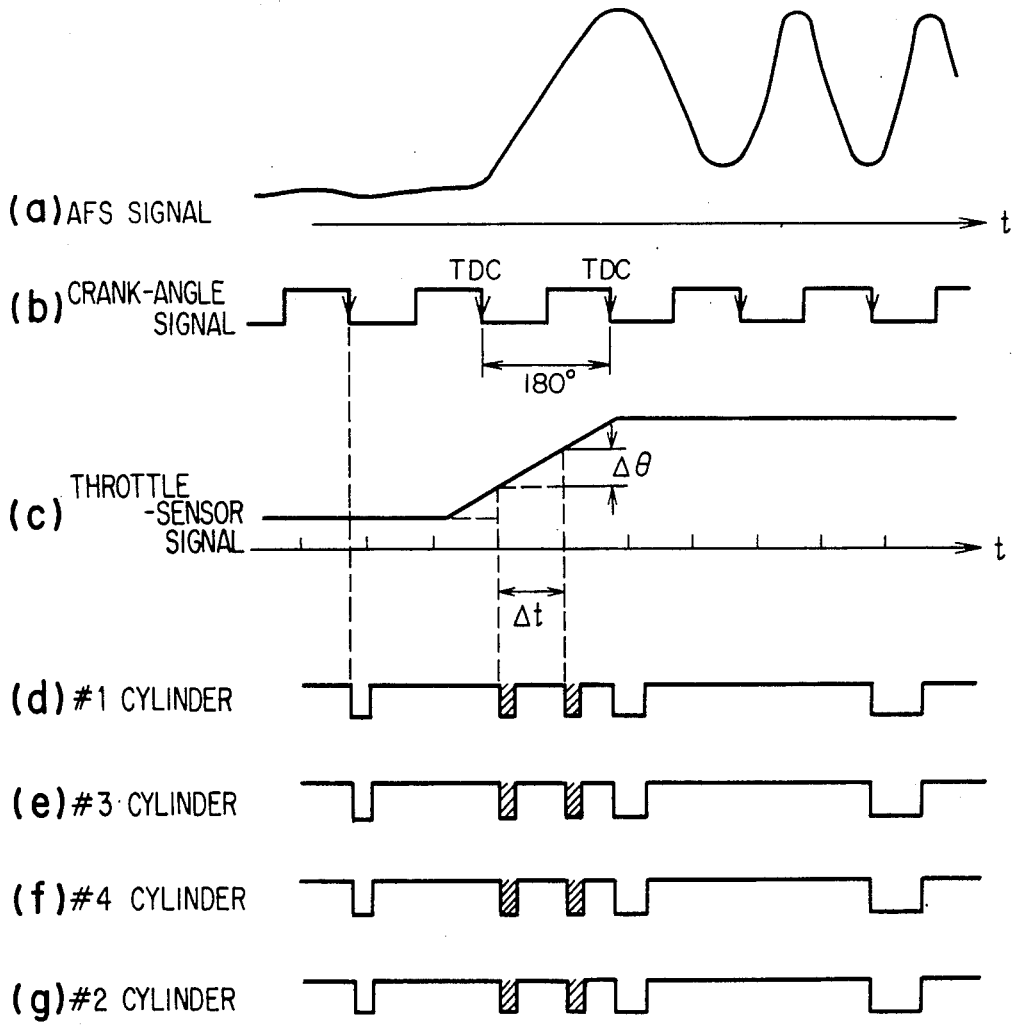
FIGS. 7, a–g show various wave forms for explaining the concept of revising engine acceleration by using the arrangement illustrated in FIG. 6.

In this invention, there is employed substantially the same hardware arrangement as that illustrated in FIG. 6 excepting that the throttle sensor 4 is omitted. FIG. 1 shows an internal arrangement of an ECU 100 which has a control program for performing a fuel injection process in accordance with the invention. In FIG. 1, the ECU 100 comprises a digital interface circuit 101 adapted to be input with output signals in the form of digital signals from a crank-angle sensor 11 and a starter switch 12; an analogue interface circuit 102 adapted to be input with output signals in the form of analogue signals from an AFS 2 and a temperature sensor 13 adapted to sense engine coolant temperature; a multiplexor 103 and an A/D converter 104 for successively converting analogue signals, fed from the AFS 2 and the temperature sensor 13 via the analogue interface 102, into digital signals; a CPU 105 having therein a ROM 105a, a RAM 105b and a timer 105*c* and adapted to generate fuel-injection pulses each having a pulse width calculated by a later-described programmed operation, as shown in FIGS. 3 through 5, on the basis of the output signals fed from the digital interface circuit 101 and the A/D inverter 104 to the CPU 105; and an injector drive circuit 106 for driving injectors 9 at the above-described pulse width obtained from the timer 105c.

Figure 2:
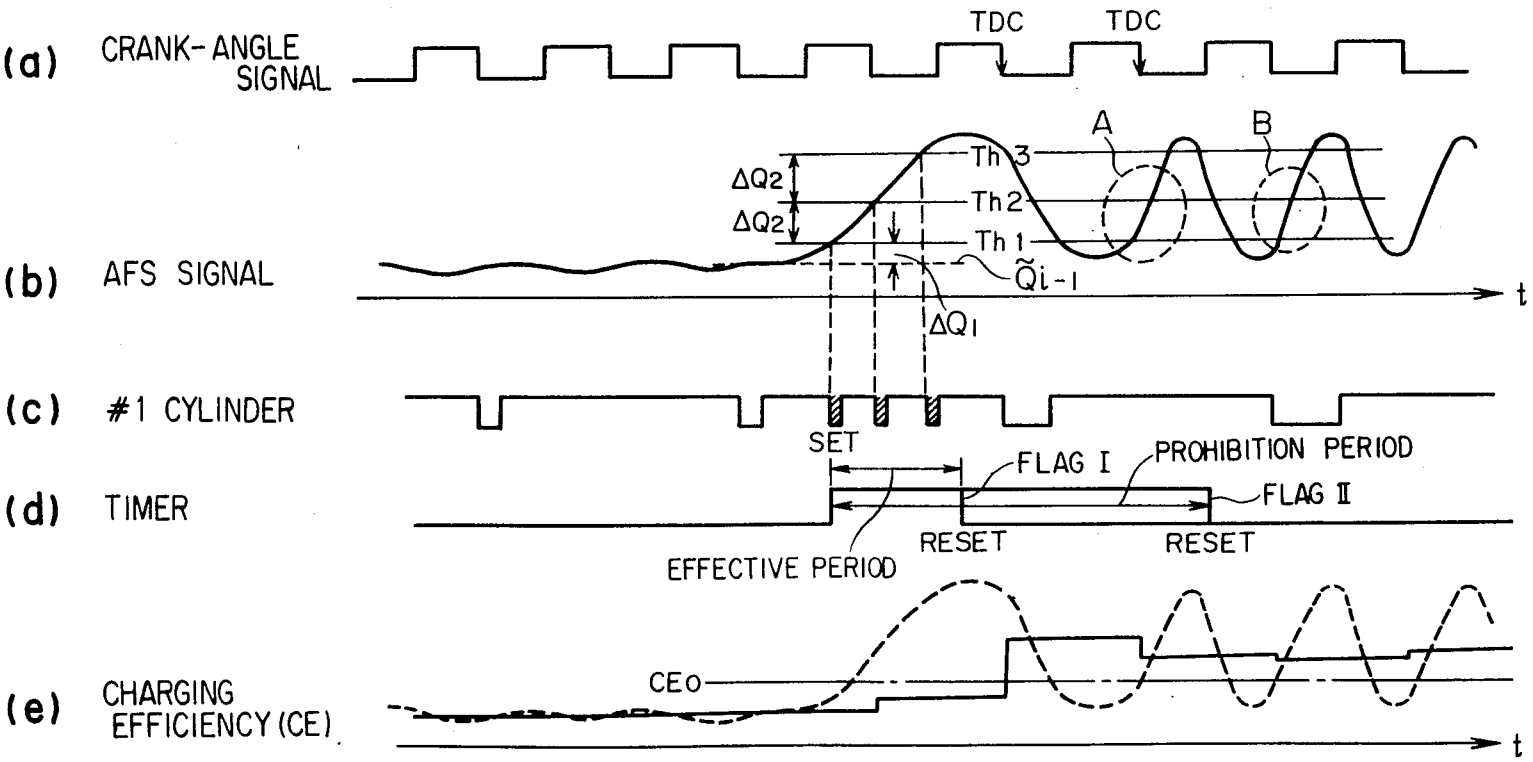
FIGS. 2, a–e show various wave forms for explaining the inventive concept of revising engine acceleration.

FIG. 2 shows various wave forms for explaining the concept of how special pulses are generated during acceleration of an engine in accordance with the present invention. FIG. 2(*a*) shows the above-mentioned crank-angle signal from the crank-angle sensor 11, and FIG. 2(*b*) an AFS signal from the AFS 2.

Assuming that a threshold for the amount of air at which a special pulse is generated is represented by Th, the first threshold $Th_1$ of a special pulse series is expressed by the following formula;

$$Th_1=\widetilde{Q}_{i-1}+Q_1$$

where the average amount of air sucked into the engine between the preceding TDC and the i-number of TDCs is represented by $Q_{i-1}$. In this case, when the amount of air sucked into the engine exceeds the threshold $Th_1$, the CPU 105 operates to generate a first special pulse, as shown in FIG. 2(c), and at the same time reset the threshold. The threshold at i times after the first threshold is determined by the following formula;

$$Th_i=Th_{1-l}+\Delta Q_2$$

where $\Delta Q_2$ is selected to be larger than $\Delta Q_1(\Delta Q_2>\Delta Q_1)$. In this case, the reason for $\Delta Q_2>\Delta Q_1$ is to set the first threshold $Th_1$ at a low value so as to make the judgment on acceleration as sensitive as possible, and on the other hand, to set the succeeding thresholds after the first threshold $Th_i$ at higher values so as to prevent repeated judgments on acceleration during one acceleration operation.

Although the above processing is repeated between the respective adjacent TDCs, the CPU does not return to the processing of determining the $Th_1$ even upon receipt of a TDC signal as long as a timer flag I is set for defining an effective duration (a normal-response waveform duration) which is set upon generation of a first special pulse and reset by a counter 105*d* after a lapse of a first predetermined period of time, as illustrated in FIG. 2(*d*). In order to avoid, during acceleration, erroneous detection of an acceleration due to pulsation of intake air at a location A of the AFS signal, as shown in FIG. 2(*b*), it is necessary to prohibit judgment on acceleration so as to prevent generation of a series of special signals as long as a timer flag II is set for defining a prohibition period of time which is set upon the first judgment on acceleration and reset after a lapse of a second predetermined time duration which is larger than the intervals between adjacent TDCs, as illustrated in FIG. 2(*d*).

The above-mentioned charging efficiency CE is given by the following formula;

$$CE=\widetilde{Q}\times T\times K_a$$

where $\widetilde{Q}$ is the average amount of suction air between the adjacent TDCs, T is a cycle between the adjacent TDCs. In this connection, when the charging efficiency CE is above a predetermined value $CE_o$ as shown in FIG. 2(*e*), it is judged that the load on the engine is large, and thus there is no judgment made for generating a series of special pulses. Accordingly, it is possible to avoid pulsation at a portion A of the AFS signal as well as misjudgment resulting from such pulsation during the fully opened state of the throttle valve after a portion B of the AFS signal, as illustrated in FIG. 2(*b*). In other words, it is the intention of the present invention to generate a series of special pulses within the first predetermined period of time only during the time when detection of the charging efficiency CE is delayed (that is the engine load is low).

In this connection, it is to be noted that as seen from FIG. 2(*e*), the charging efficiency CE frequently exceeds the predetermined value $CE_o$ in the response wave-form portions (the portions other than the pulsating wave-form portions including the portions A and B) of the AFS signal, but because of a delay in detecting the charging efficiency CE as described above, there may be a case in which the charging efficiency CE does not exceed the predetermined value $CE_o$ during the above-mentioned prohibition period, where the timer flags I and II are required so as to prohibit revision of acceleration (or generation of special pulses) at pulsating portions.

The concept of the present invention is performed in the following manner as illustrated by the flow charts in FIGS. 3 through 5.

FIG. 3 shows a main routine in which the system is initialized at step S501 after a key (not shown) is turned on to supply electrical power. At step S502, a process for preventing engine stall is effected and at step S503, judgment on engine stall is made so that when it is judged that the engine has stalled, then the system returns to step S502 and the processings at steps S502 and S503 are repeated until engine stall is remedied. On the other hand, if it is judged that the engine has not stalled, at step S504, engine starting is determined according to the state of the starter switch 12, and if it is determined that the engine has started, then at step S505, the CPU 105 operates to determine the width $_{st}$ of a starting pulse in a known way on the basis of the temperature of engine coolant and then returns to step S503. On the other hand, if it is judged that the engine has not started, the CPU 105 operates to calculate various correction coefficients such as, for example, a warming-up coefficient at step S504 and then returns to step S503. Thereafter, during engine operation, the CPU 105 operates to carry out the processing from step S503 to S506 in a repeated manner.

FIG. 4 shows an interruption handling routine per 1 ms in which at step S601, the output signal from the AFS 2 is input through the analogue interface 102 and the multiplexor 103 to the A/D converter 104 where the output signal is converted from an analogue form to a digital form so as to provide a voltage $V_i$. Then, at step S602, the voltage $V_i$ is converted into a flow rate $Q_i$ in accordance with a conversion table stored in ROM 105*a*. At step S604, the charging efficiency CE, obtained at step S705 in a later-described TDC interruption routine as illustrated in FIG. 5, is compared with a predetermined value $CE_o$ so that when $CE > CE_o$, the processings of correcting acceleration from step S606 to step S610 are finished to proceed to step S611. On the other hand, if $CE \leqq CE_o$, it is judged that the engine load is low and special pulses are required, and the processing proceeds to step S605a where it is judged whether the effective period timer flag I is set or reset. In this case, if the flag I is set (that is there is no special pulse produced and hence judgment on acceleration can be made), at step S605*b*, it is judged whether the prohibition-period timer flag II is set or reset. If this flag II is reset, the flow rate $Q_i$, calculated at step S602, is compared with the threshold Th at step S606 so that when $Q_i > Th_1$, it is judged that the engine is under acceleration. In this case, at step S607, the timer flags I and II are set and then at step S609, special pulses are generated and at step 610, the threshold $Th_i$ ($Th_1$ at first) is renewed.

On the other hand, if $Q_i \leqq Th_1$ at step S606, the processing of revised acceleration is finished and the step S611 is initiated.

If it is judged at step S605 that the flag I is set, at step S608, the same judgement on acceleration as that in step S606 is made so that when the engine is in an accelerating state ($Q_i > Th_i$), the processing routine proceeds to step S609, and if otherwise, the processing of revised acceleration is finished and then step S609 is initiated. In this connection, it is to be noted that a series of special pulses as shown by the slashed shaded areas in FIG. 2(*c*) are generated through steps S605*a* to S610.

Subsequently, at step S611, it is judged whether or not a period of 5 ms has elapsed, and if so, at step S612, the other analogue signals are input through the analogue interface 102 and the multiplexor 103 to the A/D converter 104 where they are converted into digital signals through A/D conversion. If the 5 ms period has not elapsed, the entire processing routine is finished without effecting the A/D conversion.

FIG. 5 shows an interruption routine per TDC in which at step S702, a cycle T between the adjacent TDCs is calculated on the basis of the output signal from the crank-angle sensor 11. At step S702, the amount of air $\Delta Q_i$, calculated by integration at S603 in the 1 ms interruption processing routine shown in FIG. 4, is divided by the number of times of integration $\eta$ so as to provide an average amount of air $\widetilde{Q}$ between adjacent TDCs. Thereafter, at step 703, the state of the timer flag II is judged and if it is reset, the first threshold is determined at step S704, but if it is set, such determination of the first threshold is not effected.

At step S705, charging efficiency CE is determined from the formula $CE = \widetilde{Q} \times T \times K_a$, and at step S706, judgment on engine starting is conventionally made. If the engine has started, the starting pulse width $\tau_{st}$ calculated from the main routine shown in FIG. 3 is set to be $\tau$ at step S707. If otherwise, at step S708, a basic pulse width is calculated from a formula $\widetilde{Q} \times T \times K_f$, and then at step S709, arithmetic operations for various revisions ($\tau_b \times C$) are effected so as to determine a pulse width for a rotation cycle. At step S710, odd or even judgment on the number of the TDC interruption processes, and only on even number of times, the above pulse width is set into the timer 105*c* at step S711.

Although in the above embodiment, the charging efficiency CE is utilized as a parameter for representing the engine load, a vacuum sensor may be provided so as to detect vacuum in the intake manifold for the same purpose. Also, in the above embodiment, a cycle between adjacent TDCs is utilized as a cycle of rotation, but instead an ignition cycle may be used for the same purpose with the same results. In addition, for the AFS, a hot-wire type AFS is used but it may be replaced with other types of AFS such as a vane type.

As apparent from the foregoing description, the present invention provides the following advantages. A series of special pulses are generated on the basis of an output signal from an AFS in a precise manner during acceleration of an engine so that revision of engine acceleration can be made at low cost and with high precision.

What is claimed is:

1. A fuel-injection control system for an internal combustion engine in which a basic pulse width, being calculated from the amount of intake air sucked into an internal combustion engine and the number of engine revolutions, is generated in synchronization with engine revolution, and a series of special injection pulses are generated independently of the generation timing of said basic injection pulse width for revision of engine acceleration, said fuel-injection control system comprising:

an arithmetic operation means for calculating an engine load from the amount of intake air sucked into said engine and the number of engine revolutions;

a judging means for judging whether or not a parameter representative of the engine load is less than a predetermined reference value;

a first pulse-generating means adapted to generate a first special injection pulse in response to the amount of the intake air when said judging means judges that said parameter is less than the predetermined reference value;

a second pulse-generating means adapted to revise said engine acceleration outside a pulsation range in which the amount of the intake air pulsates during a first predetermined period of time starting from the generation of the first special injection pulse and to generate a series of special injection pulses; and a revision-prohibiting means for prohibiting the revision of engine acceleration in said pulsation range of the intake air during a second predetermined period of time exceeding said first predetermined period starting from the generation of the first special injection pulse.

2. A fuel-injection control system for an internal combustion engine as set forth in claim 1 wherein said parameter representative of the engine load is a charging efficiency of the engine.

3. A fuel-injection control system for an internal combustion engine as set forth in claim 2 wherein said charging efficiency is determined by an average intake air amount between previous TDCs and the cycle between TDCs.

4. A fuel-injection control system for an internal combustion engine as set forth in claim 1 wherein said first and second pulse-generating means is adapted to generate said special injection pulse each time the amount of the intake air reaches predetermined thresholds set at predetermined intervals.

5. A fuel-injection control system for an internal combustion engine as set forth in claim 4, wherein said predetermined intervals between said predetermined thresholds are set in a manner such that the first one of said intervals between said predetermined thresholds is less than the other ones of said intervals.

6. A fuel-injection control system for an internal combustion engine as set forth in claim 4 wherein said thresholds are reset to a threshold for the first one of said special pulse series at respective TDCs.

7. A fuel-injection control system for an internal combustion engine as set forth in claim 6 wherein resetting of said thresholds is stopped during the first one of said predetermined intervals.

8. A fuel-injection control system for an internal combustion engine as set forth in claim 6 wherein said threshold for the first one of said special pulse series is set on the basis of an average intake air amount between previous TDCs.

* * * * *